US007289079B2

(12) United States Patent
Rupp et al.

(10) Patent No.: US 7,289,079 B2
(45) Date of Patent: Oct. 30, 2007

(54) RADIATING ELEMENT FOR RADAR ARRAY

(75) Inventors: Robert J. Rupp, Liverpool, NY (US); Gregory T. Johnson, Liverpool, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 89 days.

(21) Appl. No.: 11/238,305

(22) Filed: Sep. 29, 2005

(65) Prior Publication Data

US 2007/0229382 A1 Oct. 4, 2007

(51) Int. Cl.
*H01Q 1/42* (2006.01)

(52) U.S. Cl. ..... 343/789; 343/772; 343/872

(58) Field of Classification Search ..... 343/789, 343/705, 708, 872, 772, 850; 333/230
See application file for complete search history.

(56) References Cited

U.S. PATENT DOCUMENTS 3,534,376 A * 10/1970 Woo ..... 343/786
4,047,181 A * 9/1977 Hoople ..... 343/789
4,211,987 A * 7/1980 Pan ..... 333/230
4,415,900 A * 11/1983 Kaloi ..... 343/700 MS
5,036,335 A 7/1991 Jairam
5,461,392 A 10/1995 Mott et al.
5,659,326 A 8/1997 McWhirter et al.
6,121,936 A 9/2000 Hemming et al.
6,404,377 B1 6/2002 Lee et al.

OTHER PUBLICATIONS

RT/durid 5870/5880 High Frequency Laminates, ROgers Corporation, ADvanced Circuit Materials, Publication #92-101 (2 pgs.) no date available.

* cited by examiner

*Primary Examiner*—Hoang V. Nguyen
(74) *Attorney, Agent, or Firm*—Plevy, Howard & Darcy, PC

(57) ABSTRACT

A radiating element for a radar array has a conductive shell defining a cavity having an aperture; a dielectric material at least partially covering the aperture, and an excitation device coupled to the cavity for exciting the cavity in a radar band. A radar array has an extended ground plane having openings therein and a radiating element situated in each of the openings, the radiating elements having a conductive shell defining a cavity with an aperture therein, dielectric material at least partially covering the aperture, and an excitation device coupled to the cavity.

27 Claims, 8 Drawing Sheets

RADIATING ELEMENT FOR RADAR ARRAY

FIELD OF INVENTION

The present invention relates to radar antennas, and particularly to radiating elements in radar antennas.

BACKGROUND

Phased radar arrays for use in radar, and particularly for use in the UHF frequency band, between about 300 megaHertz and about 1000 megaHertz, ordinarily take the form of a ground plane having radiating elements that extend through and beyond both sides of the ground plane. The radiating elements typically take the form of dipole antennas or flared notch antennas. A radome is ordinarily provided over the array beyond the radiating elements to provide protection from the weather and contaminants.

For various applications, minimizing the size and weight of phased radar arrays for use in radar bands is important. For example, for some applications, it is desirable to transport ground-based radar antenna arrays by air or ground to a particular location. Antenna arrays with dipole antennas or flared notch antennas extending beyond the ground plane occupy a large volume. As folding of the array is limited by the elements extending through both sides of the ground plane, it is not practical to fold such arrays to reduce the volume for transport. The weight of the radome adds to the weight of the ground plane and antenna elements.

While the radiating element may be a waveguide, thereby not extending beyond the ground plane, prior art waveguides, for example in the UHF band, are much larger than notch arrays or dipole antennas. Accordingly, antenna arrays using prior art waveguides for the UHF band are significantly heavier, larger, or both heavier and larger, than arrays using flared notch antennas, and are thus less desirable.

SUMMARY OF THE INVENTION

In one embodiment of the invention, a radiating element has a conductive shell defining a chamber with an opening; a dielectric covering the opening; and an excitation device coupled to the conductive shell for exciting the shell to radiate in a selected radar band.

In another embodiment of the invention, a radar array has a conductive ground plane having a plurality of openings therethrough, the openings defining an array; a radiating element positioned in each of the openings, each of the elements having a conductive shell defining a cavity having an aperture defined therein; a dielectric material at least partially closing the aperture; and an excitation device coupled to the conductive shell.

In another embodiment of the invention, a method of providing radar radiation in a selected radar band, includes the steps of providing a conductive ground plane having openings therethrough, the openings defining an array, a radiating element being positioned in each opening, each radiating element having a conductive shell defining a cavity having an aperture defined therein, and a dielectric material at least partially closing the aperture; and exciting each of the cavities to provide radiation in the selected radar band.

DETAILED DESCRIPTION

It is to be understood that the figures and descriptions of the present invention have been simplified to illustrate elements that are relevant for a clear understanding of the present invention, while eliminating, for the purpose of clarity, many other elements found in typical radar antenna arrays and radiating elements. Those of ordinary skill in the art may recognize that other elements and/or steps are desirable and/or required in implementing the present invention. However, because such elements and steps are well known in the art, and because they do not facilitate a better understanding of the present invention, a discussion of such elements and steps is not provided herein.

Figure 1:
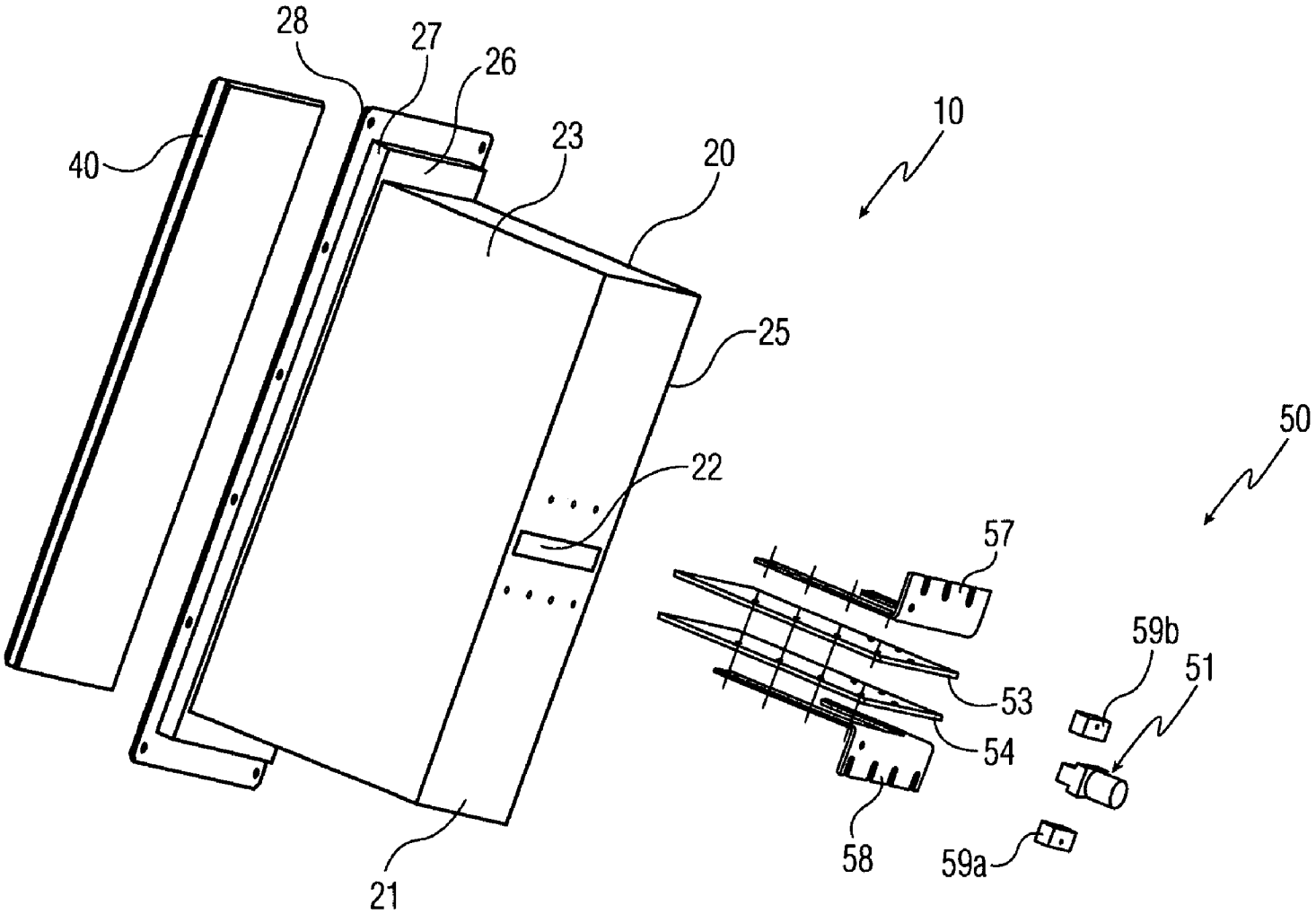
FIG. 1 is an exploded perspective view of a radiating element in accordance with an embodiment of the invention.
Figure 2:
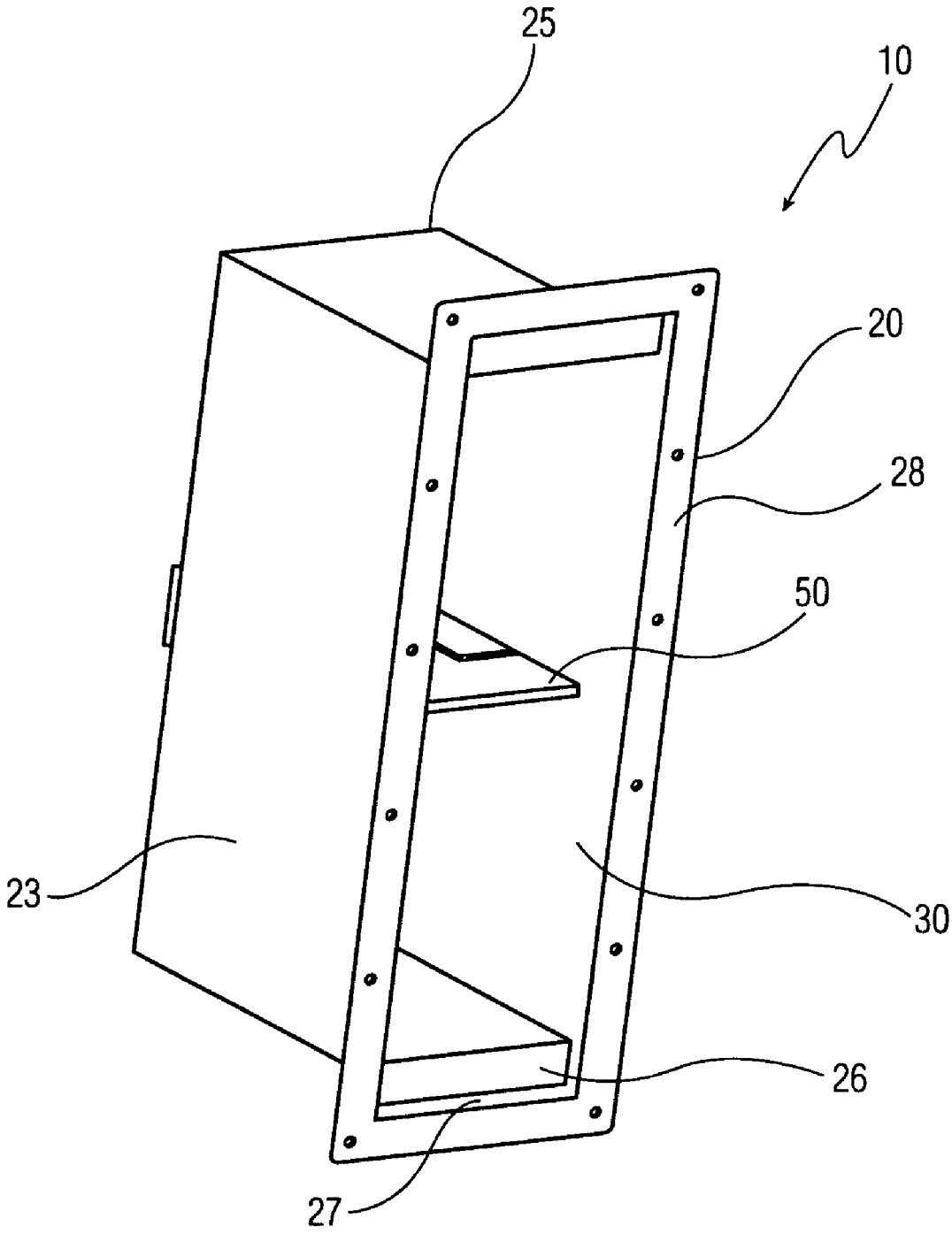
FIG. 2 is a perspective view of an alternate embodiment of the radiating element of FIG. 1, from the front, and partially assembled.
Figure 3:
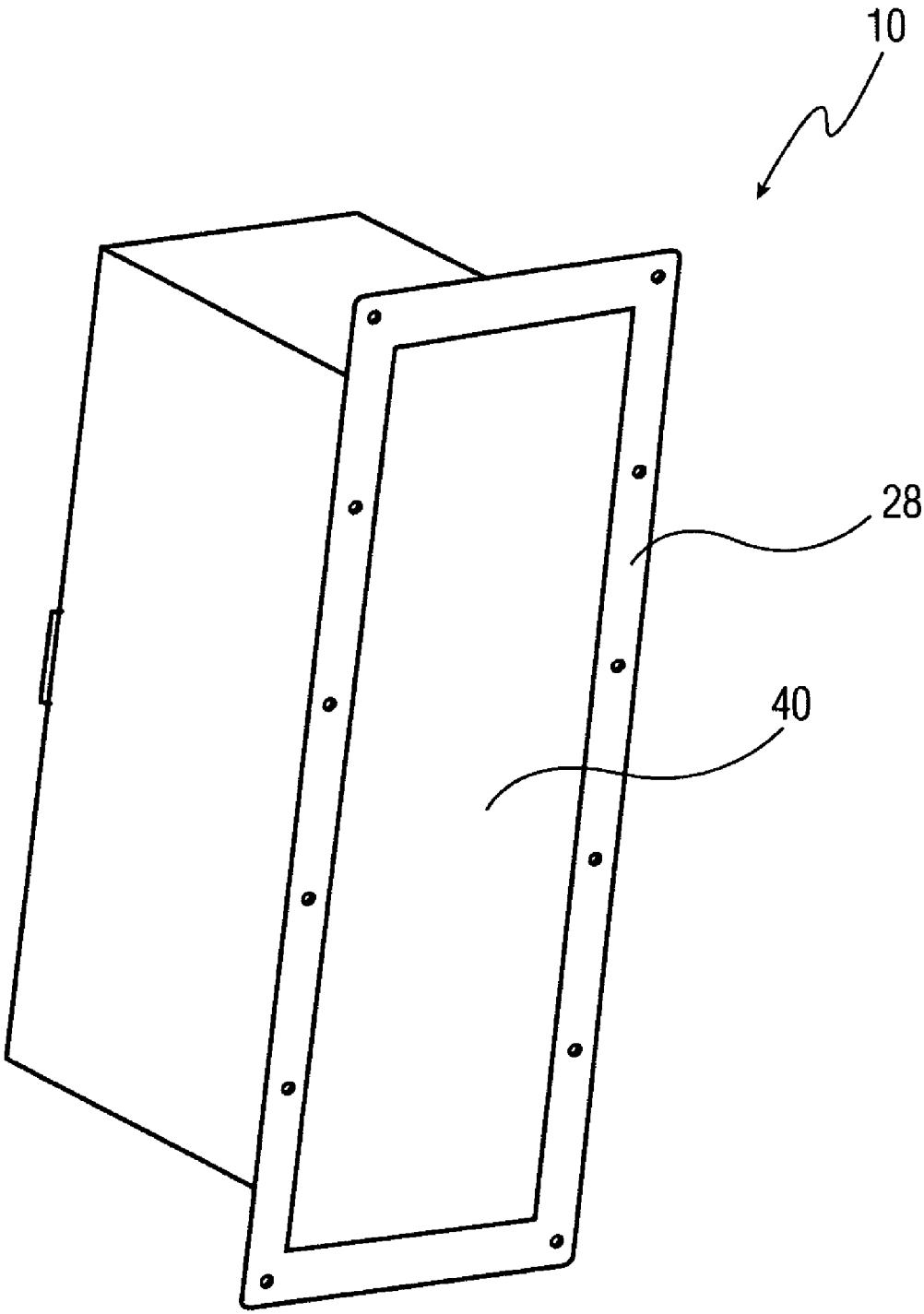
FIG. 3 is a perspective view of the radiating element of FIG. 1, from the front, and fully assembled.

Referring to FIGS. 1-3, a radiating element according to embodiments of the invention will now be described. Radiating element 10 has a conductive shell 20 which defines a cavity 25 that is substantially closed, with an aperture 30 (shown in FIG. 2) on one side thereof. In the illustrated embodiments, conductive shell 20 is generally in the form of a rectangular prism. As may be seen in FIG. 2, one side of the rectangular prism is completely open to define aperture 30. An edge of aperture 30 may lie in a plane. Conductive shell 20 also has an opening at 22 for mounting to devices for providing electromagnetic excitations. Conductive shell 20 may be made of a suitable conductor, which may be a metal such as aluminum. Conductive shell 20 may be made up of aluminum sheets, and may be fabricated by a suitable method, such as welding, a combination of bending and welding, or dip brazing. In the illustrated embodiments, cavity 25 is air filled. However, in other embodiments, cavity 25 may be filled with another dielectric, such as a foam.

Cavity 25 may be below cutoff. In other words, cavity 25 may have dimensions smaller than those of a waveguide capable of transmitting radiation at the excitation frequency. Alternatively, cavity 25 may be above cutoff; in such an embodiment, cavity 25 has dimensions equal to those of a waveguide capable of transmitting radiation at the excitation frequency.

When radiating element 10 is assembled, as shown in FIG. 3, dielectric sheet 40 is provided in aperture 30. In the illustrated embodiment, the dimensions of dielectric sheet 40 are selected so that dielectric sheet 40 completely closes aperture 30. In other embodiments of the invention, dielectric sheet 40 may partially close aperture 30. Dielectric sheet 40 may be in the form of a rectangular prism, chamfered at its edges. The dimensions and materials of dielectric sheet 40 may be selected in accordance with the following criteria. In general terms, modeling has shown that similar performance is provided using different materials for dielectric sheet 40, if the product of the thickness of dielectric sheet 40 and the dielectric constant of the material of which dielectric sheet 40 is made is similar. In an exemplary embodiment, the nominal dielectric constant of dielectric sheet 40 may be at least about 5. For example, if the dielectric sheet is of cordierite, the nominal dielectric constant will be about 6.3. In an exemplary embodiment, the nominal dielectric constant of dielectric sheet 40 may be at least about 15. Dielectric sheet 40 may be made of a composite of a material with high dielectric constant in a carrier. One example of a material with high dielectric constant is titanium dioxide. The carrier may be, for example, a plastic or a ceramic. An example of a material which may be used for dielectric sheet 40 is AK-15, also referred to as C-stock AK-500, available from Cuming Microwave Corporation, 225 Bodwell Street, Avon, Mass. 02322 USA. This material has titanium dioxide in a polybutadiene resin carrier, and has a nominal dielectric constant of about 15. Other examples of suitable materials for dielectric sheet 40 are cordierite, which has a nominal dielectric constant of about 6.3, and alumina, which has a nominal dielectric constant of about 9.8. Models predict that approximately equivalent performance is obtained with cordierite about 1 inch thick, alumina about 0.57 inches thick, and AK-15 about 0.37 inches thick.

A portion of shell 20, at a forward edge of cavity 25, may be configured to receive dielectric sheet 40 and attach to a ground plane. In the illustrated embodiments, shoulder 26 extends outward from shell side walls 23, and has a circumferential rim 27. In the embodiment of FIG. 1, shoulder 26 extends outward from all four side walls 23; in the embodiment of FIG. 2, shoulder 26 extends outward only from the upper and lower side walls. Shoulder 26 and rim 27 are of suitable size and shape to receive dielectric sheet 40. Rim 27 may have a depth substantially equal to a thickness of dielectric sheet 40. Dielectric sheet 40 is rigidly mounted on shoulder 26, such as by application of a suitable adhesive. Chamfered edges of dielectric sheet 40 provide for application of adhesive to secure dielectric sheet 40 to shell 20. In the embodiment of FIG. 1, an outer flange 28 extends outward from rim 27 for attachment, such as by fasteners, to a ground plane. In the embodiment of FIG. 2, outer flange 28 extends outward from rim 27 at the upper and lower forward edges of cavity 25, and directly from side walls 23 at the side forward edges of cavity 25. It will be appreciated that flange 28 extends radially outward at a forward edge of cavity 25.

An excitation probe assembly 50 is provided to excite cavity 25 to provide an output in a selected radar band. The selected band may be the UHF band, or may be the L-band or the S-band depending on the design details of the cavity, radome, array lattice spacing, and excitation probe. Assembly 50 may include both an excitation probe, for coupling radiation into cavity 25, and a matching circuit. A matching circuit is provided to further electrical performance of a radiating element, and to transform the characteristic impedance to a conventional value, such as 50 ohm. Referring to FIG. 1, in the illustrated embodiment, excitation probe assembly 50 is a stripline device with a connector 51 for coupling to a source of a signal, such as a coaxial cable. The design of stripline devices is well-known to those of ordinary skill in the design of radar antennas. In FIG. 1, dielectric substrates 53, 54, are illustrated, but metallization of dielectric substrates 53, 54, is not shown. Dielectric substrates 53, 54, are supported by brackets 57, 58, which are coupled to a rear wall 21 of shell 20. Connector 51 is supported by brackets 59*a*, 59*b*, which are also coupled to rear wall 21. Connector 51 may be a blind mate connector.

By providing cavity 25 in the form of a rectangular prism with one side open, a rectangular cavity waveguide with an aperture is defined. In design of radiating element 10, the aperture admittance may be obtained by using analytical tools known to those of skill in the art for calculating the aperture admittance of rectangular waveguides with dielectric covers. For example, the aperture admittance is dependent on factors including the frequency and scan angle, the configuration of the array, the dimensions of cavity 25, the thickness and dielectric constant of dielectric sheet 40, the configuration of the stripline dielectric substrates 53, 54 and the brackets 57, 58 on which they are supported.

Figure 4A:
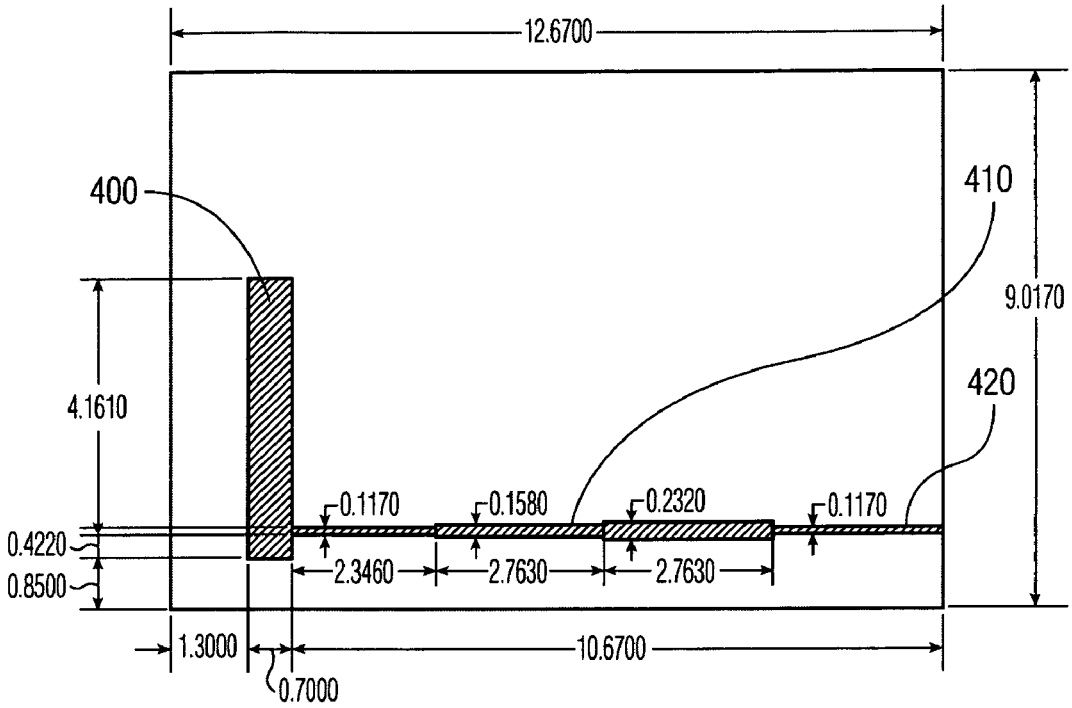
FIGS. 4A and 4B represent exemplary metallization patterns for an exemplary substrate in a stripline assembly in a radiating element of FIG. 1.
Figure 4B:
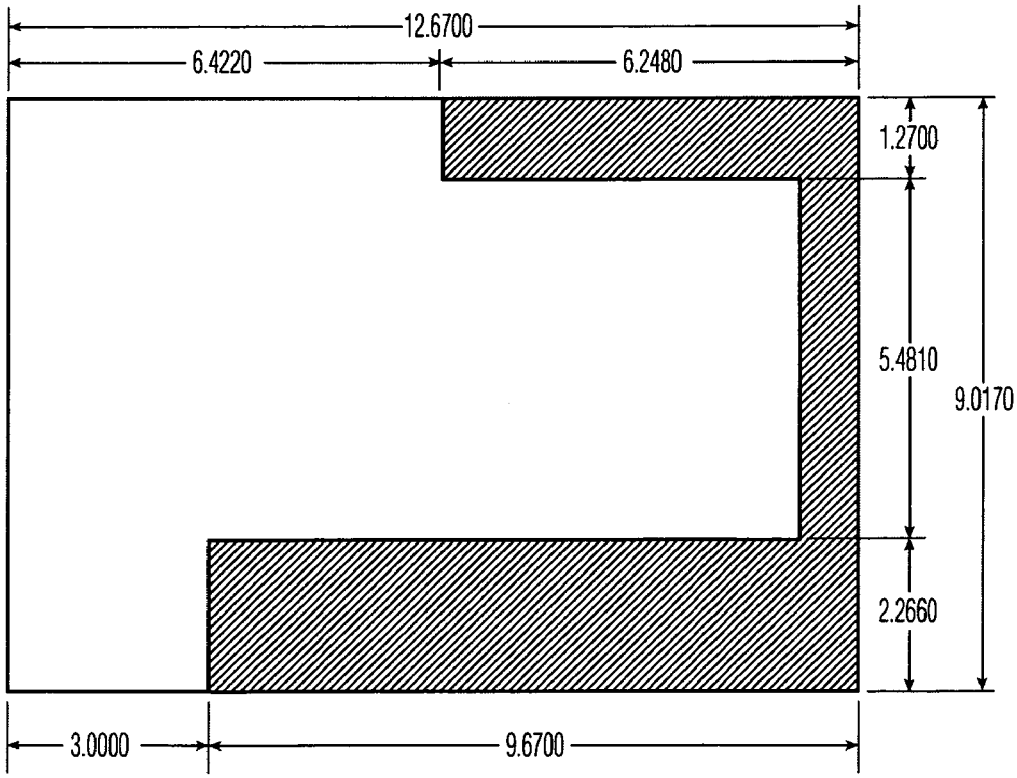

For dielectric substrates 53, 54, materials with a range of dielectric constant may be used. For example, either Duroid 5880, from Rogers Corporation, Advanced Circuit Materials Division, of Chandler, Ariz., which is a glass-reinforced PTFE, with a dielectric constant of about 2.2, or TMM10, also available from Rogers Corporation, Advanced Circuit Materials Division, of Chandler, Ariz., which is a ceramic filled plastic, with a dielectric constant of about 9.2, may be employed. It will be appreciated that other dielectric materials may be used for the substrates. An exemplary metallization pattern for a stripline board, made of TMM10, is shown in FIGS. 4A and 4B, with dimensions shown in centimeters. In FIG. 4A, an excitation element is shown at 400, a 50 ohm input line at 420, and an impedance matching transformer 410 coupling excitation element 400 to input line 420. In FIG. 4B, exemplary metallization of an opposite side of a board is shown. It will be appreciated that the dimensions of the various elements may be varied depending on such factors as the substrate material, the desired frequency, and the dimensions of the cavity.

Figure 5:
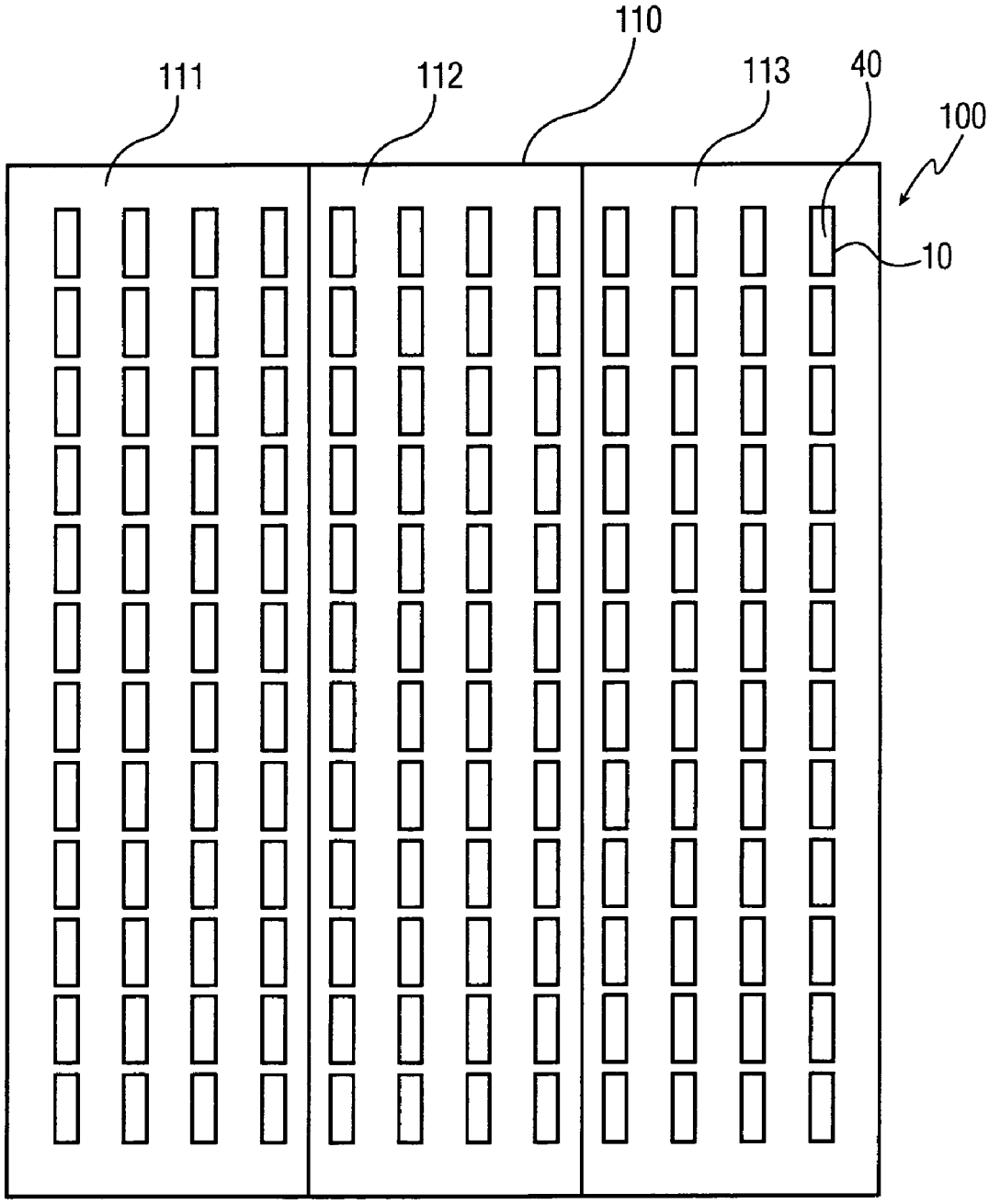
FIG. 5 is a plan view of an array antenna in accordance with an embodiment of the invention.

Referring to FIG. 5, an array antenna 100 in accordance with an embodiment of the invention is shown in a front plan view. Array antenna 100 has ground plane 110, in which elements 10 are mounted to define an array. In this example, elements 10 are mounted in a rectangular array. Ground plane 110 is an electrically conductive sheet, which may be of aluminum, having openings 120 defined therein for insertion of elements 10. Openings 120 may better be seen in FIG. 6. In the disclosed embodiment, ground plane 110 is a planar conductive sheet, although in some embodiments of the invention, ground plane 110 may be curved.

Ground plane 110 has three sections 111, 112, 113, which are hingedly attached to one another, and are maintained at the same electrical potential by suitable connections. Any suitable hardware may be provided to implement a hinged connection between section 111 and section 112, and between section 112 and section 113. Connectors among sections 111, 112, 113 may provide electrical connections, or separate conductive connections may be provided. For ease of illustration, no hardware is shown in the figures. Ground plane 110 may be folded to a more compact size for transportation and storage. It will be appreciated that three sections 111, 112 and 113 are merely exemplary, and two or more sections may be provided. In this embodiment, dielectric sheet 40 completely covers each aperture of elements 10 in ground plane 110. By selection of a waterproof material for dielectric sheet 40, or by application of a suitable coating to render dielectric sheet 40 waterproof, and upon applying a suitable seal, a single continuous, waterproof surface may be provided. Dielectric sheet 40 thus serves as an integral radome.

Figure 6:
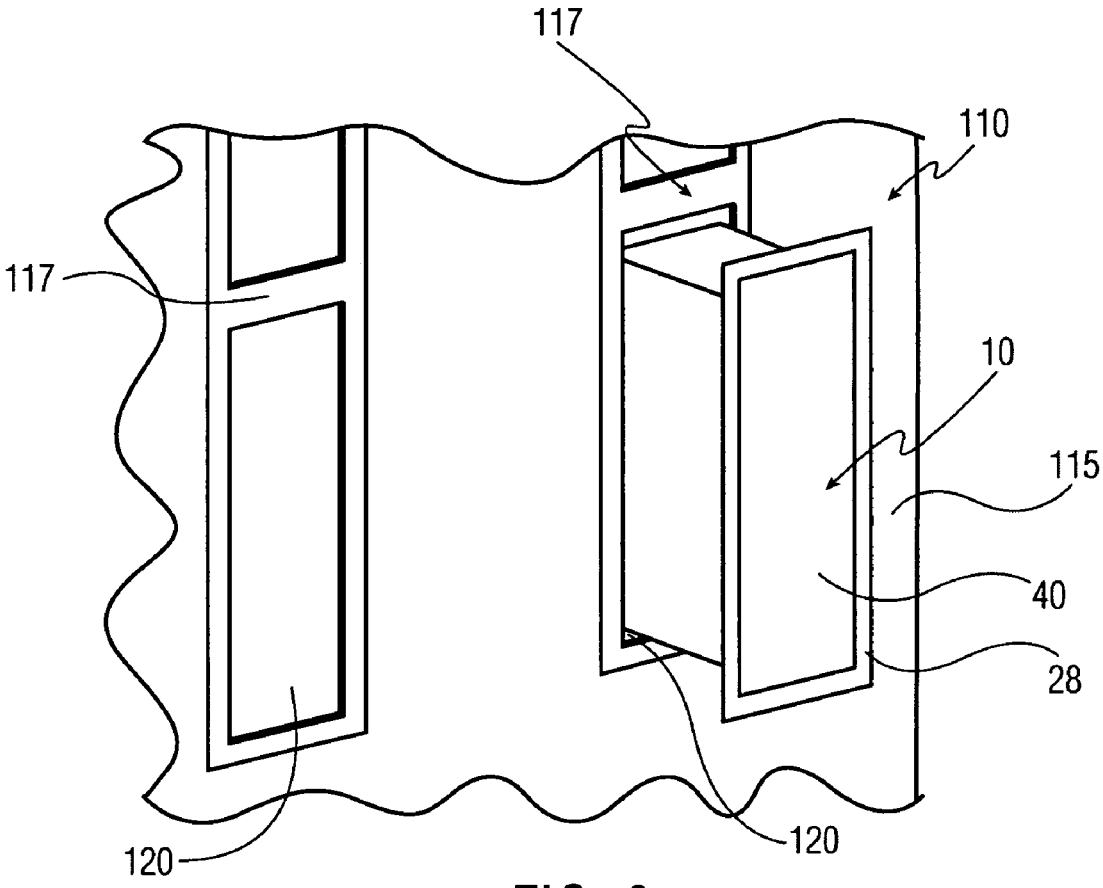
FIG. 6 is a partial isometric view of an array antenna of FIG. 5, with an antenna element partially removed.

Referring to FIG. 6, there is shown a partial isometric view from the front of array 100, with an element 10 partially inserted through opening 120 into ground plane 110. Opening 120, flange 28, and the other portions of element 10, are so shaped and dimensioned that portions of element 10 other than flange 28 (including cavity 25), pass through opening 120, but flange 28 does not. Ground plane 110 has a major surface 115, and a recessed surface 117 surrounding each opening in ground plane 110. Recessed surface 117 accommodates flange 28 of radiating element 10. Accordingly, a substantially planar array surface, made up of major surface 115, flanges 28, and dielectric sheets 40, may be obtained. It may also be seen that element 10 may be fixed in place in array 100 by fastening of flange 28 to ground plane 110, such as by use of fasteners. It will be appreciated that mounting of elements 10 is simple, as each element 10 need only be inserted through a corresponding opening 120 until flange 28 contacts ground plane 110. Flange 28 may be attached to ground plane 110, such as by screws, bolts or other fasteners. The fasteners are preferably readily reversible, so that element 10 can be removed for repair or replacement. It will be appreciated that physical insertion and removal of elements 10 in ground plane 110 may be accomplished entirely from the front side of ground plane 110. Also, insertion and removal of elements does not require removal of a separate radome, or maneuvering tools and parts around a separate radome. Connector 51, shown in FIG. 1, may be a blind mate connector, which would obviate the need to manipulate connector 51 in order to connect to a source of signals.

Figure 7A:
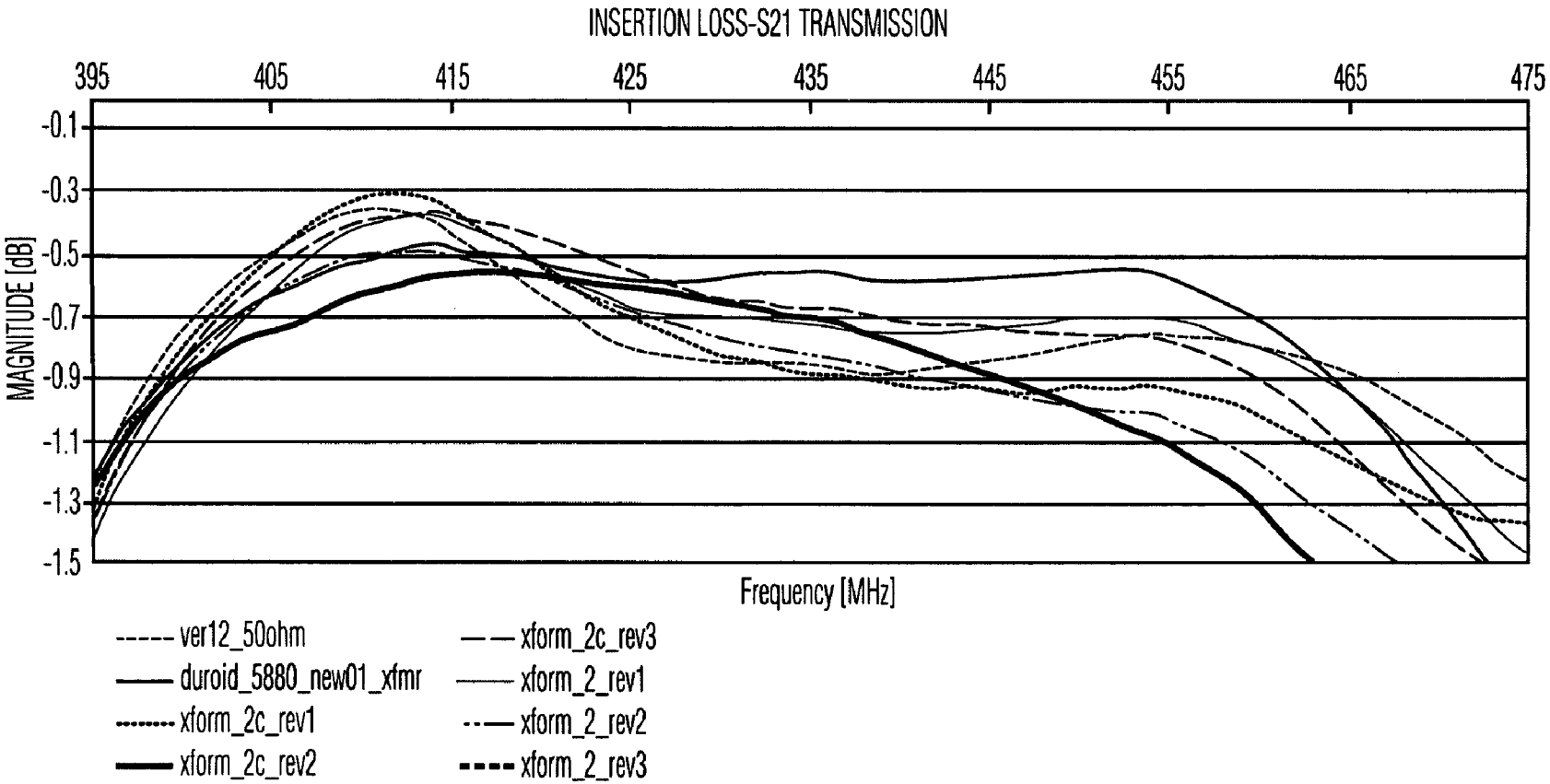
FIGS. 7A and 7B are plots of insertion loss as measured in a waveguide simulator employing various embodiments of an array antenna according to the invention.
Figure 7B:
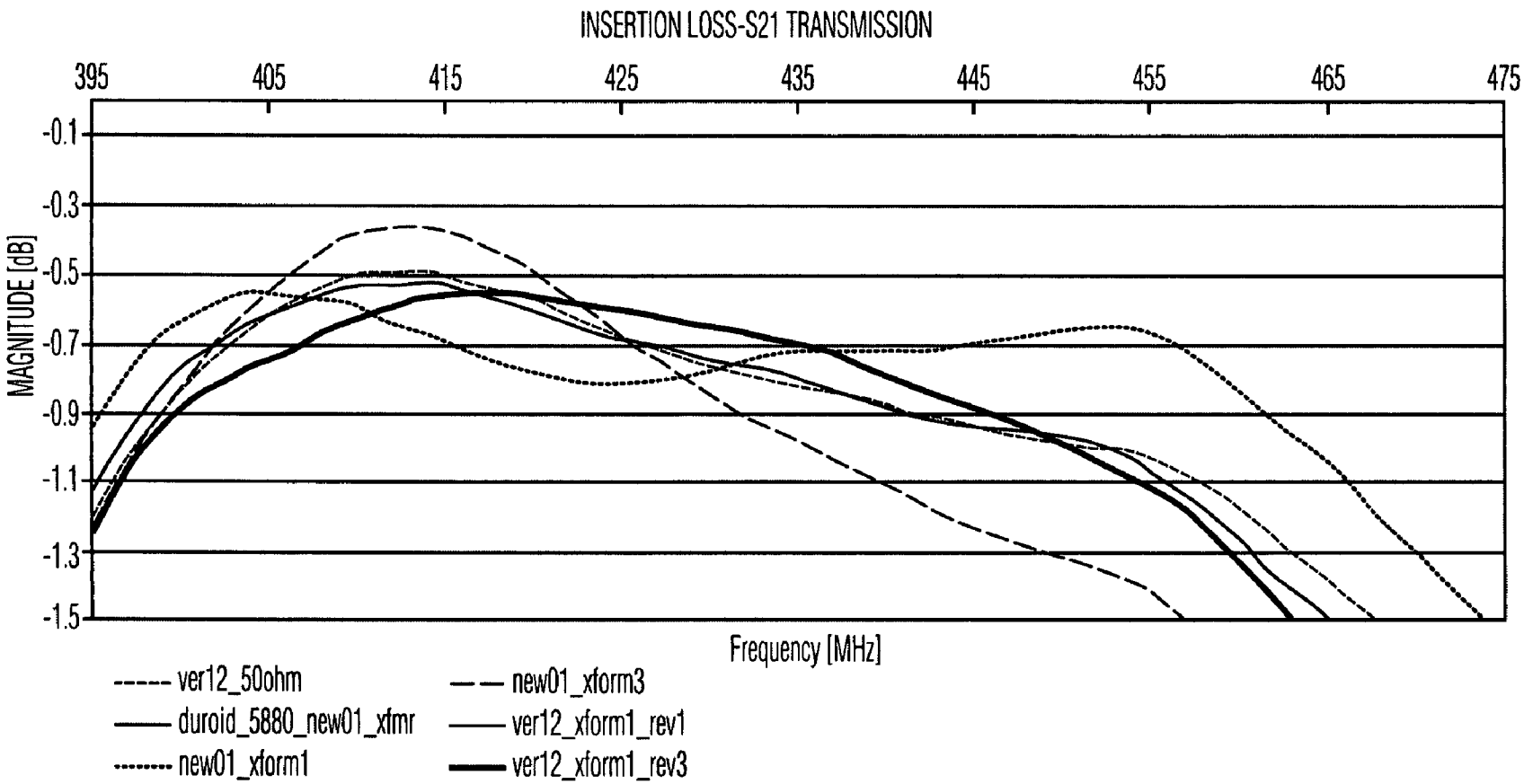

In tests with exemplary implementations of radiating elements according to the invention, and simulated arrays, the signal loss shown in FIG. 7A and FIG. 7B was achieved. Each line in FIGS. 7A and 7B represents a different embodiment of the invention. The insertion loss in each embodiment was measured by a network analyzer with the radiating element in a waveguide simulator. The waveguide simulator approximated a 30 degree scan angle in the H-plane. In a band from about 395 MHz to about 455 MHz, insertion loss for S21 transmission provides acceptable results.

In an embodiment of the invention, the cavity may have a height of no more than about 24 inches, a depth of about 10 inches, and a width of about 8 inches. In an embodiment of the invention, the cavity may have an overall height of about 11 inches, a depth of about 5.5 inches, and a width of about 4 inches.

While the foregoing invention has been described with respect to an implementation in the UHF frequency band, the teachings of the invention may be applied to L-band and S-band as well. Those of skill in the art will be able to design suitable cavities, excitation devices, and dielectric sheets, for elements in accordance with the invention for providing radiation in these bands. It will be appreciated that the elements may differ; for example, as wavelengths are shorter in L-band and S-band than in the UHF band, a cavity for use in L-band or S-band may be smaller than a cavity for use in the UHF band.

While the disclosed embodiments provide for a single excitation device in a cavity, multiple excitation devices may be employed in a single cavity. In an embodiment in which multiple excitation devices are provided in a single cavity, the cavity may be elongated in a vertical direction.

Implementation of radiating elements and a radar antenna in accordance with the teachings of the invention provide various advantages. One exemplary advantage is that a cavity waveguide may be employed as the radiating element, with considerably smaller size and consequently less weight than in prior art waveguides, particularly waveguides for use in the UHF band. In embodiments in which the dielectric sheet completely covers the aperture of the element, a further exemplary advantage is the capacity to protect the cavities and electronics from moisture and contaminants without a separate radome, thereby reducing the weight and cost of fabrication of the array. The absence of a separate radome in some embodiments also permits removal and replacement of elements without having to remove a radome, or maneuver elements and tools around the radome. A further example of an advantage of some embodiments of the invention is the relative ease of folding the array to reduce volume for transportation of the array. Furthermore, in some embodiments of the invention, the elements may be so disposed to permit insertion and removal from the front side of the ground plane, without a need for access to the rear of the ground plane.

While the foregoing invention has been described with reference to the above-described embodiments, various modifications and changes can be made without departing from the spirit of the invention. Accordingly, all such modifications and changes are considered to be within the scope of the appended claims.

What is claimed is:

1. A radiating element for a radar array antenna, comprising:

a conductive shell defining a cavity having an aperture defined therein and a second opening;

a dielectric material at least partially closing the aperture; and an excitation device removably coupled to the conductive shell, for exciting the cavity in a selected radar band, the excitation device being removable through the second opening.

2. The radiating element of claim 1, wherein said dielectric material has a nominal dielectric constant of at least about 5.

3. The radiating element of claim 2, wherein said dielectric material has a nominal dielectric constant of at least about 15.

4. The radiating element of claim 1, wherein said dielectric material is in the form of a generally flat sheet.

5. The radiating element of claim 4, wherein said dielectric material completely covers said aperture.

6. The radiating element of claim 1, wherein said cavity is rectangular.

7. The radiating element of claim 1, wherein said excitation device comprises a stripline device extending into said cavity.

8. The radiating element of claim 7, wherein said stripline device comprises a dielectric substrate and a conductive layer on the substrate, the conductive layer defining an integrated transformer and an excitation element.

9. The radiating element of claim 8, wherein said dielectric material has a nominal dielectric constant of at least about 15.

10. The radiating element of claim 7, wherein said stripline device is mounted transverse to said aperture.

11. The radiating element of claim 1, wherein said excitation device comprises a probe and a transformer.

12. The radiating element of claim 1, wherein said element further comprises a flange extending radially outward at a forward edge of said cavity.

13. The radiating element of claim 1, wherein the selected radar band is the UHF band.

14. A radar array, comprising:

a conductive ground plane having a plurality of openings therethrough, said openings defining an array;

a radiating element positioned in each said opening, each of said elements having a conductive shell defining a cavity having an aperture defined therein; a dielectric material at least partially closing the aperture; and an excitation device coupled to the conductive shell.

15. The radar array of claim 14, wherein said dielectric material has a nominal dielectric constant of at least about 5.

16. The radar array of claim 15, wherein said dielectric material has a nominal dielectric constant of at least about 15.

17. The radar array of claim 16, wherein each of said excitation devices is a stripline device comprising a dielectric substrate and a conductive layer on the substrate, the conductive layer defining an integrated transformer and an excitation element.

18. The radar array of claim 14, wherein the array is rectangular.

19. The radar array of claim 14, wherein said dielectric material fully covers said apertures, and said radiating elements completely cover said openings, whereby said ground plane, said radiating elements and said dielectric material provide a continuous surface.

20. The radar array of claim 19, wherein said continuous surface is waterproof.

21. The radar array of claim 20, wherein said dielectric material has a nominal dielectric constant of at least about 15.

22. The radar array of claim 14, wherein each of said cavities is rectangular.

23. The radar array of claim 14, wherein each of said cavities is dimensioned to pass through said openings, and each of said elements has a flange extending radially outward at a forward edge of said cavity, whereby said elements may be inserted through said openings and said flange may be fastened to said ground plane to maintain said element in place in said array.

24. The radar array of claim 14, wherein said excitation device is adapted to excite said cavity in the UHF band.

25. The radar array of claim 14, wherein each of said conductive shells has a second opening therein, each of the excitation elements being removably coupled to one of said conductive shells and removable through said second opening.

26. The radar array of claim 25, wherein each of said second openings is opposite one of the apertures; said dielectric material fully covers said apertures, and said radiating elements completely cover said openings, whereby said ground plane, said radiating elements and said dielectric material provide a continuous surface.

27. A method of providing radar radiation in a selected radar band, comprising the steps of:

providing a conductive ground plane having a plurality of openings therethrough, said openings defining an array, a radiating element being positioned in each said opening, each of said radiating elements having a conductive shell defining a cavity having an aperture defined therein, and a dielectric material at least partially closing the aperture; and exciting each of said cavities to provide radiation in the selected radar band.

* * * * *